US006630792B2

(12) United States Patent
Okumura

(10) Patent No.: US 6,630,792 B2
(45) Date of Patent: Oct. 7, 2003

(54) HIGH FREQUENCY POWER SOURCE, PLASMA PROCESSING APPARATUS, INSPECTION METHOD FOR PLASMA PROCESSING APPARATUS, AND PLASMA PROCESSING METHOD

(75) Inventor: Tomohiro Okumura, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 71 days.

(21) Appl. No.: 10/081,587

(22) Filed: Feb. 21, 2002

(65) Prior Publication Data

US 2002/0113738 A1 Aug. 22, 2002

(30) Foreign Application Priority Data

Feb. 22, 2001 (JP) ..... 2001-046052

(51) Int. Cl.[7] ..... H05H 1/24

(52) U.S. Cl. ..... 315/111.21; 118/723 I; 156/345.28; 156/345.44

(58) Field of Search ..... 315/111.21, 111.41, 315/111.51, 111.31, 111.61, 111.71; 118/723 AN, 723 MW, 723 R, 723 I; 156/345.28, 345.24, 345.48, 345.44

(56) References Cited

U.S. PATENT DOCUMENTS 5,543,689 A * 8/1996 Ohta et al. ..... 315/111.21
5,643,364 A * 7/1997 Zhao et al. ..... 118/723 I
5,810,963 A * 9/1998 Tomioka ..... 156/345.28
5,849,136 A * 12/1998 Mintz et al. ..... 315/111.21
5,892,198 A * 4/1999 Barnes et al. ..... 219/121.54
5,936,481 A * 8/1999 Fujii ..... 333/17.3
6,027,601 A * 2/2000 Hanawa ..... 118/723 I
6,066,994 A * 5/2000 Shepherd et al. ..... 333/109
6,333,634 B1 * 12/2001 Haze et al. ..... 315/111.21

* cited by examiner

*Primary Examiner*—Don Wong
*Assistant Examiner*—Ephrem Alemu
(74) *Attorney, Agent, or Firm*—Jordan and Hamburg LLP

(57) ABSTRACT

A gas supplying device introduces a predetermined gas into a vacuum chamber, while an evacuation device is exhausting the gas to maintain the inside of the vacuum chamber at a predetermined pressure. A high frequency power source for an antenna is supplied to an antenna provided protrudingly into the vacuum chamber with a high frequency power to generate plasma inside the vacuum chamber, and plasma processing is applied to a substrate placed on an electrode. Providing a low pass filter whose cut-off frequency is higher than the oscillating frequency of the high frequency power source between a traveling wave output terminal of a directional coupler, and an amplifier in the high frequency power supply for an antenna precisely controls power.

26 Claims, 3 Drawing Sheets

HIGH FREQUENCY POWER SOURCE, PLASMA PROCESSING APPARATUS, INSPECTION METHOD FOR PLASMA PROCESSING APPARATUS, AND PLASMA PROCESSING METHOD

The present disclosure relates to subject matter contained in priority Japanese Patent Application No. 2001-46052, filed on Feb. 22, 2001, the contents of which is herein expressly incorporated by reference in its entirety.

BACKGROUND OF THE INVENTION

1. Field of the Invention

The present invention relates to a high frequency power source, a plasma processing apparatus, an inspection method for a plasma processing apparatus, and a plasma processing method used for manufacturing electronic devices such as semiconductors and liquid crystal display devices, and micro electro-mechanical systems.

2. Description of Related Art

The importance of a thin film machining technology by means of plasma processing is increasing in manufacturing electronic devices such as semiconductors and liquid crystal display devices, and micro electro-mechanical systems.

Plasma processing using a patch antenna type plasma source will be described below as an example of a conventional plasma processing. A predetermined gas is introduced into a vacuum chamber from a gas supplying device while an evacuation device evacuates the vacuum chamber to maintain the inside of the vacuum chamber at a predetermined pressure. A high frequency power source for an antenna supplies an antenna provided protrudingly in the vacuum chamber with a high frequency power with a frequency (f) of 100 MHz. Consequently plasma is generated in the vacuum chamber, and a plasma processing operation is performed to a substrate placed on an electrode placed in the vacuum chamber.

FIG. 5 shows a detailed view of a high frequency power source 104 for an antenna. An amplifier 23 amplifies a signal with a high frequency (f) of 100 MHz generated from a high frequency oscillator 22, and a high frequency output terminal 25 provides a high frequency power through a directional coupler 24. When the amplifier 23 amplifies the signal from the high frequency oscillator 22, a signal from a traveling wave output terminal 26 of the directional coupler 24, and a signal from an output power setting circuit 31 are compared with each other to provide a constant high frequency power. A power indicator 30 is provided to show a traveling wave power and a reflected wave power based on a signal from the traveling wave output terminal 26, and a signal from a reflected wave output terminal 28 of the directional coupler 24.

A matching circuit 20 shown in FIG. 6 is provided to match the impedance of the antenna with the characteristic impedance of a coaxial line.

However, there is a problem that precise power control and precise power monitoring are not available in the plasma processing of prior art. When a load is linear, a harmonic wave is not generated on a power system from the high frequency power source 104 to the load. When a load with strong non-linearity such as plasma is used, a harmonic wave is generated on the load. Because the high frequency power source 104, and the matching circuit 20 match the frequency (f) of the oscillator 22, and do not match a higher harmonic wave with a frequency such as 2*f*, 3*f*, and 4*f*, there are standing waves, which are higher harmonic waves, on the power system from the high frequency power source 104 to a load. Thus, when a state of a load, plasma generating conditions such as the kind of the gas, a flow rate of the gas, the pressure, and the high frequency power, the length of the coaxial line, and a deposit state of the inner wall of the vacuum chamber change the locations of nodes and antinodes of the standing waves as well as the amplitudes of the generated higher harmonic waves change. Consequently, a ratio of a higher harmonic wave component to a fundamental wave component contained in the signal from the traveling wave output terminal 26 of the directional coupler 24 changes. As a result, a gain of the amplifier 23 changes, a fundamental wave power destabilized, and the power cannot be controlled precisely. Simultaneously, a power value shown on the power indicator 30 includes the harmonic waves, and the fundamental wave power cannot be precisely monitored.

When the high frequency power is measured in an inspection for a plasma processing apparatus as shown in FIG. 6, if a directional coupler 32 for inspection provided with a traveling wave output terminal 33 for inspection, and a reflected wave output terminal 34 for inspection is provided on a coaxial line 21, because it is impossible to precisely monitor the power due to the effect from the standing waves of the higher harmonic waves, the plasma processing apparatus is not precisely inspected.

For example, when plasma was generated immediately after a wet maintenance of the vacuum chamber while an argon gas flow rate was 100 sccm, and a high frequency power was 1500 W, and the pressure changed from 0.3 to 2 Pa, the value of the high frequency power measured by the directional coupler 32 for inspection presented a variation from 1400 W to 1540 W, which is a deviation of plus or minus 4.8 percent from 1470 W.

SUMMARY OF THE INVENTION

In light of the foregoing, an object of the present invention is to provide a high frequency power source, a plasma processing apparatus, and a plasma processing method for precise power control, and an inspection method for precise power monitoring.

A high frequency power source according to a first aspect of the present invention includes a high frequency oscillator, an amplifier, a directional coupler provided with a traveling wave output terminal and a reflected wave output terminal, a high frequency wave output terminal, and an output power setting circuit. In this high frequency power source thus constituted, a signal from the traveling wave output terminal, and a signal from the output power setting circuit are compared to provide a constant high frequency power from the high frequency wave output terminal when the amplifier amplifies a signal from the high frequency oscillator, and a low pass filter with a cut-off frequency (fh) higher than an oscillating frequency (f) of the high frequency oscillator is provided between the traveling wave output terminal and the amplifier.

A plasma processing apparatus according to a second aspect of the invention includes a vacuum chamber, a gas supplying device for supplying the vacuum chamber with gas, an evacuation device for evacuating the vacuum chamber, an electrode for placing a substrate in the vacuum chamber, an antenna provided so as to face the electrode, a high frequency power source for providing the antenna or the electrode with a high frequency power with a frequency of (f), a matching circuit, and a coaxial line for connecting the high frequency power source with the matching circuit, wherein a low pass filter is provided between a traveling wave output terminal and an amplifier in the high frequency power source.

An inspection method for a plasma processing apparatus according to a third aspect of the invention is an inspection method for a plasma processing apparatus comprising a vacuum chamber, a gas supplying device for supplying the vacuum chamber with gas, an evacuation device for evacuating the vacuum chamber, an electrode for placing a substrate in the vacuum chamber, an antenna provided so as to face the electrode, a high frequency power source for providing the antenna or the electrode with a high frequency power with a frequency of (f), a matching circuit, and a coaxial line for connecting the high frequency power source with the matching circuit, where the high frequency power source is provided with a low pass filter, and a high frequency power passing through the coaxial line is measured while a directional coupler for inspection provided with a traveling wave output terminal for inspection and a reflected wave output terminal for inspection is provided on the coaxial line, and the low pass filter with a cut-off frequency (fk) higher than an oscillating frequency (f) of a high frequency oscillator is provided between the traveling wave output terminal for inspection and a power measuring device for inspection.

A plasma processing method according to a forth aspect of the invention includes the procedures of controlling an inside of a vacuum chamber at a predetermined pressure while the vacuum chamber is being supplied with gas, and is simultaneously being evacuated, applying a high frequency power with a frequency (f) to an electrode or an antenna facing a substrate placed on the electrode in the vacuum chamber through a coaxial line and a matching circuit, and generating plasma inside the vacuum chamber to process the substrate. In this method, when a signal from a high frequency oscillator is amplified in an amplifier in a high frequency power source, a signal from a traveling wave output terminal of a directional coupler in the high frequency power source through a low pass filter with a cut-off frequency (fh) higher than an oscillating frequency (f) of the high frequency oscillator is compared with a signal from an output power setting circuit in the high frequency power source to apply a constant high frequency power to process the substrate.

While novel features of the invention are set forth in the preceding, the invention, both as to organization and content, can be further understood and appreciated, along with other objects and features thereof, from the following detailed description and examples when taken in conjunction with the attached drawings.

DETAILED DESCRIPTION OF THE PREFERRED EMBODIMENTS

Embodiments of the present invention will be described in detail hereinbelow with reference to FIG. 1 through FIG. 4.

Figure 1:
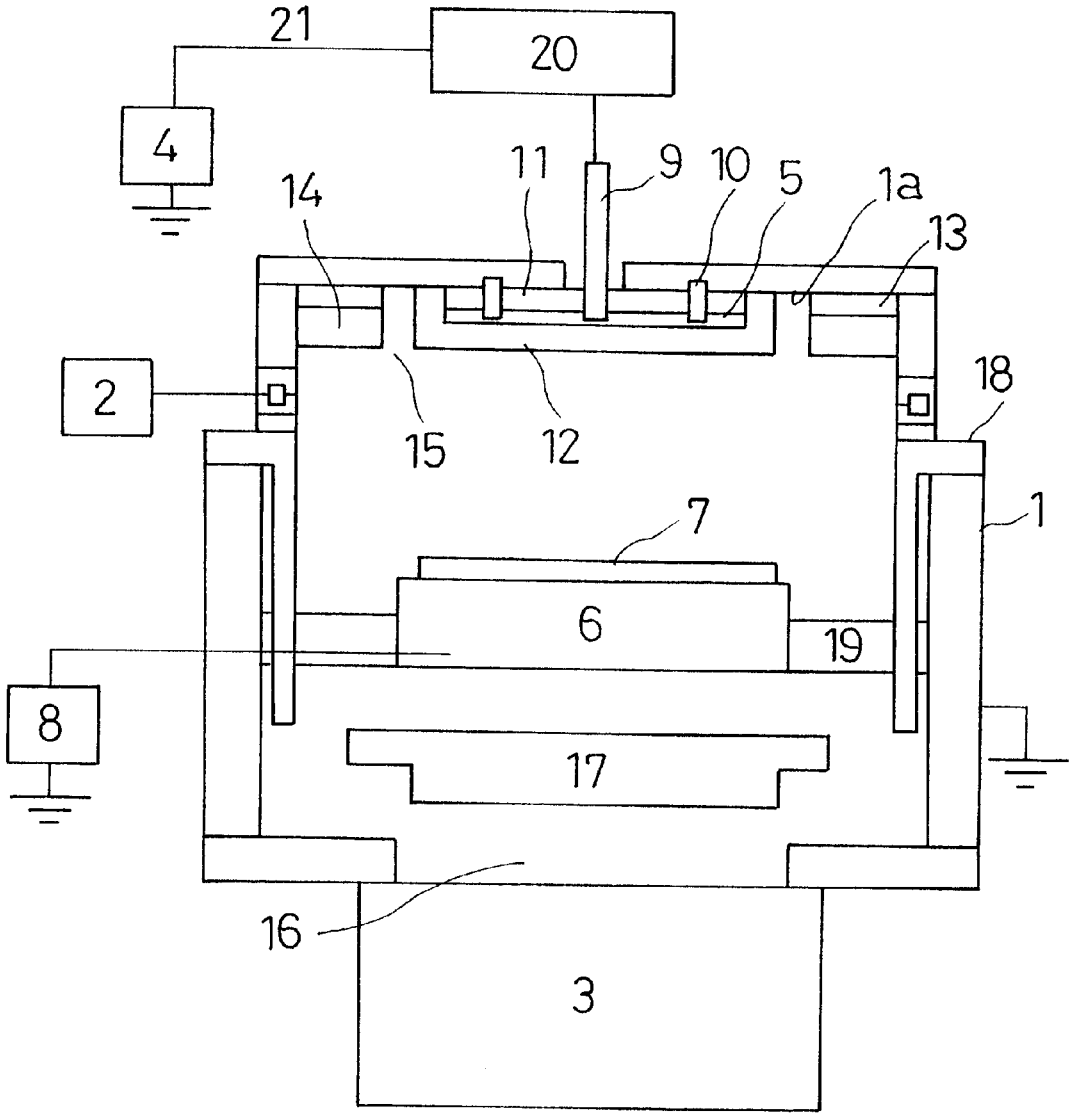
FIG. 1 is a sectional view showing a constitution of a plasma processing apparatus used in an embodiment of the present invention.

FIG. 1 shows a sectional view of a plasma processing apparatus used in the embodiment.

A predetermined gas is introduced into a vacuum chamber 1 from a gas supplying device 2 while a turbomolecular pump 3 serving as an evacuation device evacuates the vacuum chamber 1 to maintain the inside of the vacuum chamber 1 at a predetermined pressure. A high frequency power source 4 for an antenna supplies an antenna 5 provided protrudingly in the vacuum chamber 1 with a high frequency power with a frequency (f) of 100 MHz. Consequently plasma is generated in the vacuum chamber 1, and a plasma processing operation is performed to a substrate 7 placed on an electrode 6 placed in the vacuum chamber 1. A high frequency power source 8 for the electrode is provided for supplying the electrode 6 with a high frequency power, and controls ion energy reaching the substrate 7. A feeding rod 9 supplies the antenna 5 with a high frequency voltage in the vicinity of a center of the antenna 5. Short pins 10 short-circuit between each of multiple locations which are different from the center or the periphery of the antenna 5, and a surface 1*a* facing the substrate 7 in the vacuum chamber 1. A dielectric plate 11 is provided between the antenna 5 and the vacuum chamber 1. The feeding rod 9 connects the antenna 5 to a matching circuit 20 through a through hole provided in the dielectric plate 11. The short pins 10 connect the antenna 5 to the surface 1*a* of the vacuum chamber 1 through through holes provided in the dielectric plate 11. A surface of the antenna 5 is covered with a cover 12. A plasma trap 15 comprising a groove-like space between the dielectric plate 11 and a dielectric ring 13 provided outside the periphery of the dielectric plate 11, and a groove-like space between the antenna 5 and a conductor ring 14 provided outside the periphery of the antenna 5 is provided.

The turbomolecular pump 3 and an exhaust opening 16 are provided just below the electrode 6. A pressure-regulating valve 17 is an elevating valve placed just below the electrode 6, and just above the turbomolecular pump 3. The pressure-regulating valve 17 adjusts the inside of the vacuum chamber 1 to a predetermined pressure. An inner chamber 18 covers an inner wall surface of the vacuum chamber 1 to prevent the plasma processing operation from contaminating the vacuum chamber 1. Changing a contaminated inner chamber 18 after processing a predetermined number of substrates 7 quickly completes a maintenance operation. Four struts 19 fix the electrode 6 to the vacuum chamber 1.

The matching circuit 20 matches the impedance of the antenna 5 with the characteristic impedance of a coaxial line 21.

Figure 2:
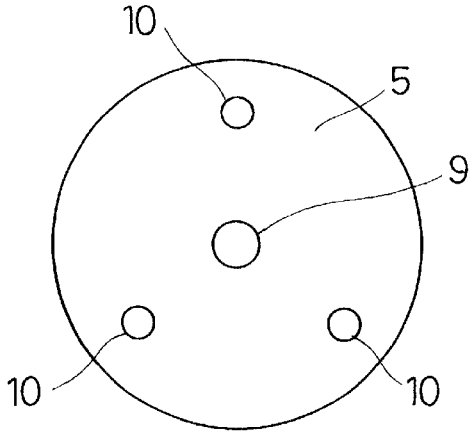
FIG. 2 is a plan view of an antenna used in the embodiment.

FIG. 2 shows a plan view of the antenna 5. The short pins 10 are provided at three locations in FIG. 2. The individual short pins 10 are placed at equal distances from the center of the antenna 5.

Figure 3:
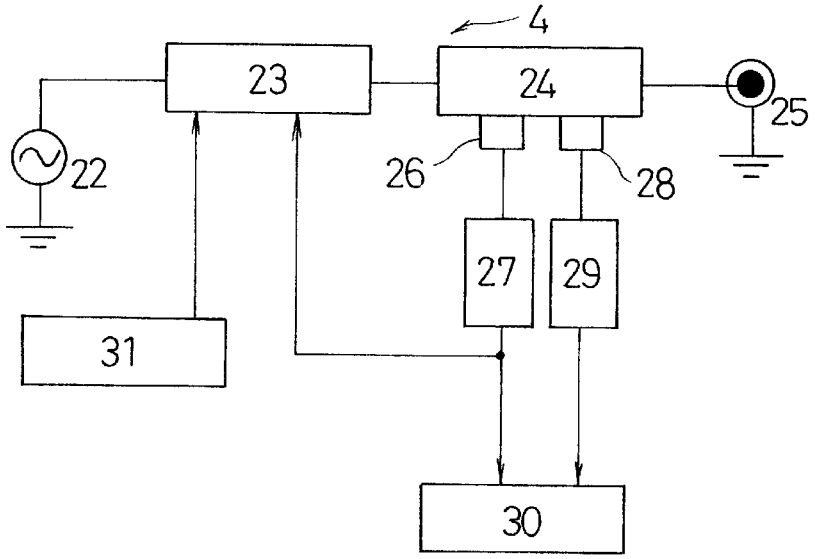
FIG. 3 is a detailed view of a high frequency power source for an antenna used in the embodiment.

FIG. 3 shows a detailed view of a high frequency power source 4 for an antenna used in the embodiment. An amplifier 23 amplifies a high frequency signal with f=100 MHz generated from a high frequency oscillator 22, and a high frequency output terminal 25 provides a high frequency power through a directional coupler 24. When the amplifier 23 amplifies the signal from the high frequency oscillator 22, a signal from a traveling wave output terminal 26 of the directional coupler 24, and a signal from an output power setting circuit 31 are compared to provide a constant high frequency power. A low pass filter 27 whose cut-off frequency fh=120 MHz, which is higher than the oscillating frequency of the high frequency oscillator 22, is provided between the traveling wave output terminal 26, and the amplifier 23. A power indicator 30 is provided to show a traveling wave power and a reflected wave power based on a signal from the traveling wave output terminal 26, and a signal from a reflected wave output terminal 28 of the directional coupler 24. Another low pass filter 29 whose cut-off frequency fh=120 MHz, which is higher than the oscillating frequency of the high frequency oscillator 22, is provided between the reflected wave output terminal 28 and the power indicator 30.

Figure 4:
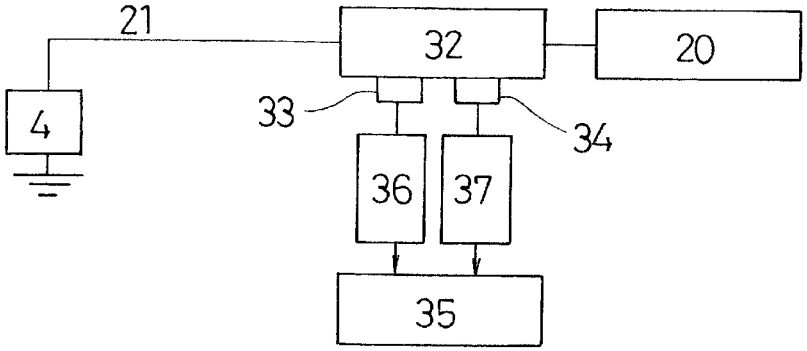
FIG. 4 is a detailed view of an inspection system used in the embodiment.
Figure 5:
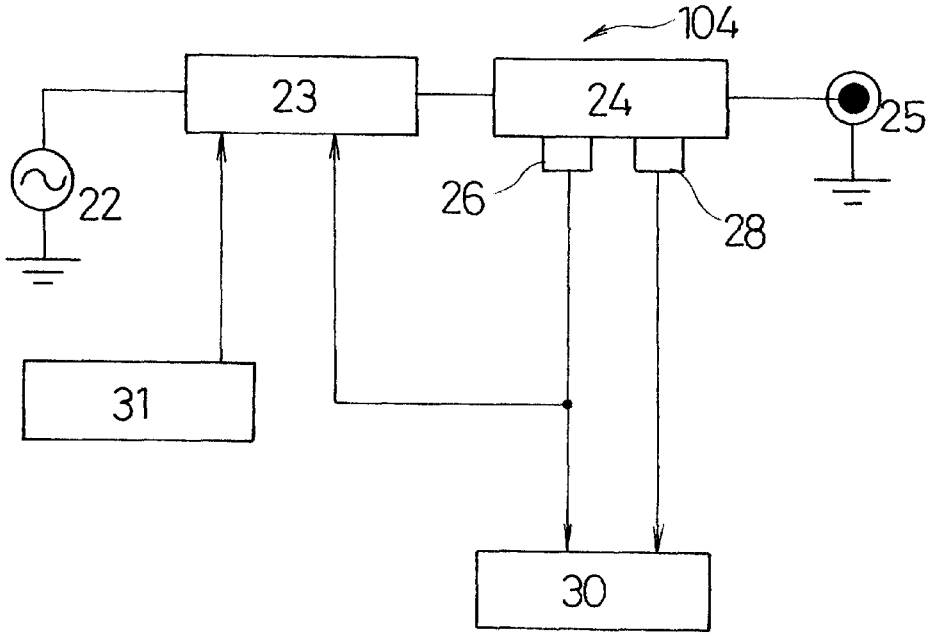
Fig. 5 Prior Art
FIG. 5 is a detailed view of a high frequency power source for an antenna of a conventional example.
Figure 6:
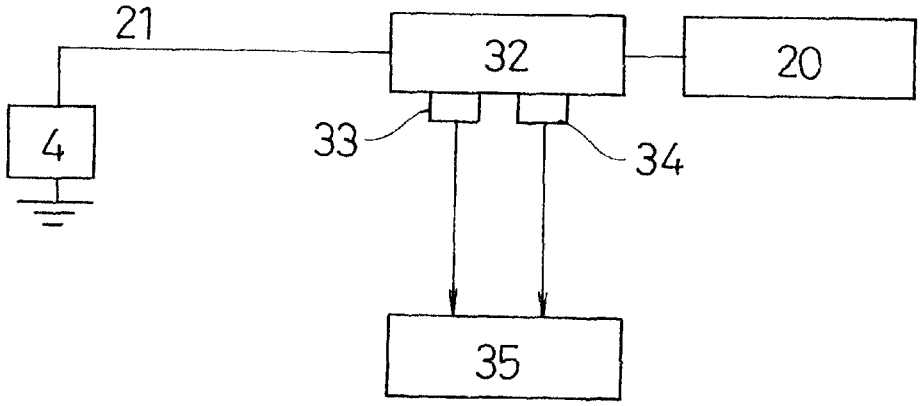
Fig. 6 Prior Art
FIG. 6 is a detailed view of an inspection system of a conventional example.

A directional coupler 32 for inspection provided with a traveling wave output terminal 33 for inspection, and a reflected wave output terminal 34 for inspection is provided on the coaxial line 21 as shown in a detailed view for an inspection system in FIG. 4, and a high frequency power supplied for the plasma processing apparatus, and a reflected power are measured. A low pass filter 36 whose cut-off frequency fk=120 MHz, which is higher than the oscillating frequency (f) of the high frequency oscillator 22, is provided between the traveling wave output terminal 33 for inspection, and a power measuring device 35 for inspection. A low pass filter 37 whose cut-off frequency fk=120 MHz, which is higher than the oscillating frequency (f) of the high frequency oscillator 22, is provided between the reflected wave output terminal 34 for inspection, and the power measuring device 35 for inspection.

For example, when plasma was generated immediately after a wet maintenance of the vacuum chamber 1 while an argon gas flow rate was 100 sccm, and a high frequency power was 1500 W, the pressure changed from 0.3 to 2 Pa, and the traveling wave power measured 1490 W to 1510 W (1500 W±0.7%), presenting a drastically smaller deviation compared with the conventional example was conducted. It is considered that this is a consequence of providing the low pass filters 27 and 36, precisely conducting the power control within the high frequency power source 4 for an antenna based only on the fundamental wave power to eliminate an effect from the harmonic waves, and measuring only the fundamental wave power in the power measuring device 35 for inspection to eliminate the effect from the harmonic waves.

As a comparison, a measurement without the low pass filter 27 in the high frequency power source 4 for an antenna, and with the low pass filter 36 for the inspection system presented approximately ±5% deviation in measured values. It is considered that this is a consequence of imprecisely monitoring the power due to the harmonic waves affecting the inspection system in spite of precisely controlling the power in the high frequency power source 4 for an antenna.

Inversely, a measurement with the low pass filter 27 in the high frequency power source 4 for an antenna, and without the low pass filter 36 for the inspection system presented approximately ±5% deviation in measured values. It is considered that this is a consequence of imprecisely controlling the power in the high frequency power source 4 for an antenna due to an effect from the harmonic waves in spite of precisely monitoring the power.

Though the case for applying the present invention to the high frequency system of the antenna was described, it is also possible to apply the present invention to the electrode system for placing a substrate.

Though the case where the frequency (f) of the high frequency power (the frequency of the oscillator) impressed on the antenna is 100 MHz was described, the frequency (f) is not limited thereto. The present invention is especially effective when the frequency is from 0.1 MHz to 3 G MHz. The invention is more effective when the frequency is from 50 MHz to 300 MHz.

Though the case where the cut-off frequency fh or fk is 1.2f was described, it is desirable that the fh and fk satisfy f<fh<2f, and f<fk<2f to reduce the effect of the entire higher harmonic waves including the second harmonic wave.

Though the case was described where a power indicator is provided to display the traveling wave power, and the reflected wave power based on the signal from the traveling wave output terminal of the directional coupler after passing through the low pass filter, and the signal from the reflected wave output terminal of the directional coupler, the power indicator may not be provided if it is not necessary to indicate the powers.

The case was described where a low pass filter with a cut-off frequency fh which is higher than the oscillating frequency (f) of the high frequency oscillator is provided between the reflected wave output terminal of the directional coupler, and the power indicator. This constitution allows precisely monitoring the reflected wave of the fundamental wave power without receiving the effect from the harmonic waves.

The case was described where a low pass filter with a cut-off frequency fk which is higher than the oscillating frequency (f) of the high frequency oscillator is provided between the reflected wave output terminal for inspection of the directional coupler for inspection, and the power measuring device. This constitution allows precisely measuring the reflected wave of the fundamental wave power without receiving the effect from the harmonic waves.

The case was described where a dielectric plate is provided between the antenna and the vacuum chamber, the antenna and the dielectric plate have a structure protruding into the vacuum chamber, the antenna is supplied with the high frequency power through a through hole provided near a center of the dielectric plate, and the antenna and the vacuum chamber are short-circuited with multiple short pins through multiple through holes provided on multiple locations on the dielectric plate different from the center or the periphery, at equal distances from the center of the antenna. This constitution allows increasing the isotropy of the plasma. It is obvious that sufficiently high homogeneity on the surface is obtained without short pins when the substrate is small. The present invention is effective when using connecting means other than the antenna used in the embodiment of the invention such as a coil for an inductively coupled plasma source, or an antenna for radiating electromagnetic waves for a surface wave plasma source.

As set forth above, because the high frequency power source, the plasma processing apparatus and the plasma processing method of the present invention precisely monitor and control power while eliminating the effect from the harmonic waves, they conduct a stable plasma processing. Also, because the inspection method of the present invention precisely monitors the power while eliminating the effect from the higher harmonic waves, it precisely inspects a plasma processing apparatus.

Although the present invention has been fully described in connection with the preferred embodiment thereof, it is to be noted that various changes and modifications apparent to those skilled in the art are to be understood as included within the scope of the present invention as defined by the appended claims unless they depart therefrom.

What is claimed is:

1. A high frequency power source comprising:

a high frequency oscillator;

an amplifier;

a directional coupler provided with a traveling wave output terminal and a reflected wave output terminal;

a high frequency wave output terminal; and an output power setting circuit, wherein a signal from the traveling wave output terminal, and a signal from the output power setting circuit are compared with each other to provide a constant high frequency power from the high frequency wave output terminal when the amplifier amplifies a signal from the high frequency oscillator, and a low pass filter with a cut-off frequency higher than an oscillating frequency of the high frequency oscillator is provided between the traveling wave output terminal and the amplifier.

2. The high frequency power source according to claim 1, wherein the oscillating frequency (f) and the cut-off frequency (fh) satisfy a relationship of f<fh<2f.

3. The high frequency power source according to claim 1, further comprising a power indicator for showing a traveling wave power and a reflected wave power based on a signal from the traveling wave output terminal after passing through the low pass filter, and a signal from the reflected wave output terminal.

4. The high frequency power source according to claim 3, wherein a low pass filter with a cut-off frequency higher than the oscillating frequency of the high frequency oscillator is provided between the reflected wave output terminal and the power indicator.

5. The high frequency power source according to claim 1, wherein the oscillating frequency is 0.1 MHz to 3 G MHz.

6. The high frequency power source according to claim 1, wherein the oscillating frequency is 50 MHz to 300 MHz.

7. A plasma processing apparatus comprising:

a vacuum chamber;

a gas supplying device for supplying the vacuum chamber with a gas;

an evacuation device for evacuating the vacuum chamber;

an electrode for placing a substrate in the vacuum chamber;

an antenna provided so as to face the electrode;

a high frequency power source for providing the antenna or the electrode with a high frequency power, a matching circuit; and a coaxial line for connecting the high frequency power source with the matching circuit, wherein the high frequency power source comprises a high frequency oscillator, an amplifier, a directional coupler provided with a traveling wave output terminal and a reflected wave output terminal, a high frequency wave output terminal, an output power setting circuit, and a low pass filter provided between the traveling wave output terminal and the amplifier, the low pass filter having a cut-off frequency higher than an oscillating frequency of the high frequency oscillator.

8. The plasma processing apparatus according to claim 7, wherein the oscillating frequency (f) and the cut-off frequency (fh) satisfy a relationship of f<fh<2f.

9. The plasma processing apparatus according to claim 7, further comprising a power indicator for showing a traveling wave power and a reflected wave power based on a signal from the traveling wave output terminal after passing through the low pass filter, and a signal from the reflected wave output terminal.

10. The plasma processing apparatus according to claim 9, wherein a low pass filter with a cut-off frequency higher than the oscillating frequency of the high frequency oscillator is provided between the reflected wave output terminal and the power indicator.

11. The plasma processing apparatus according to claim 7, wherein the oscillating frequency is 0.1 MHz to 3 G MHz.

12. The plasma processing apparatus according to claim 7, wherein the oscillating frequency is 50 MHz to 300 MHz.

13. The plasma processing apparatus according to claim 7, wherein a dielectric plate is provided between the antenna and the vacuum chamber, the antenna and the dielectric plate have a structure protruding into the vacuum chamber, the antenna is supplied with the high frequency power through a through hole provided near a center of the dielectric plate, and the antenna and the vacuum chamber are short-circuited with multiple short pins through multiple through holes provided at multiple locations on the dielectric plate different from the center or the periphery, at equal distances from the center of the antenna.

14. An inspection method for a plasma processing apparatus comprising: a vacuum chamber; an electrode for placing a substrate in the vacuum chamber; an antenna provided so as to face the electrode; a high frequency power source for providing the antenna or the electrode with a high frequency power, the power source comprising a high frequency oscillator, an amplifier, a directional coupler provided with a traveling wave output terminal and a reflected wave output terminal, a high frequency wave output terminal, an output power setting circuit, and a low pass filter provided between the traveling wave output terminal and the amplifier, the low pass filter having a cut-off frequency higher than an oscillating frequency of the high frequency oscillator; a matching circuit; and a coaxial line for connecting between the high frequency power source and the matching circuit, the method comprising the procedures of:

arranging a directional coupler for inspection on the coaxial line, the directional coupler having a traveling wave output terminal for inspection and a reflected wave output terminal for inspection;

arranging a low pass filter between the traveling wave output terminal for inspection and a power measuring device for inspection, the low pass filter with a cut-off frequency higher than the oscillating frequency of the high frequency oscillator; and measuring a high frequency power passing through the coaxial line.

15. The inspection method for a plasma processing apparatus according to claim 14, wherein the oscillating frequency (f) and the cut-off frequency (fh) of the low pass filter of the high frequency power source satisfy a relationship of f<fh<2f, and the oscillating frequency (f) and the cut-off frequency (fk) of the low pass filter of the directional coupler for inspection satisfy a relationship of f<fk<2f.

16. The inspection method for a plasma processing apparatus according to claim 14, wherein measuring of a high frequency power is performed while a low pass filter with a cut-off frequency higher than the oscillating frequency of the high frequency oscillator is provided between the reflected wave output terminal for inspection and the power measuring device for inspection.

17. The inspection method for a plasma processing apparatus according to claim 14, wherein the oscillating frequency is 0.1 MHz to 3 G MHz.

18. The inspection method for a plasma processing apparatus according to claim 14, wherein the oscillating frequency is 50 MHz to 300 MHz.

19. The inspection method for a plasma processing apparatus according to claim 14, wherein, in the plasma processing apparatus to be inspected, a dielectric plate is provided between the antenna and the vacuum chamber, the antenna and the dielectric plate have a structure protruding into the vacuum chamber, the antenna is supplied with the high frequency power through a through hole provided near a center of the dielectric plate, and the antenna and the vacuum chamber are short-circuited with multiple short pins through multiple through holes provided at multiple locations on the dielectric plate different from the center or the periphery, at equal distances from the center of the antenna.

20. A plasma processing method comprising:

controlling an inside of a vacuum chamber at a predetermined pressure while the vacuum chamber is being supplied with a gas, and is simultaneously being evacuated;

applying a high frequency power to an electrode or an antenna facing a substrate placed on the electrode in the vacuum chamber through a coaxial line and a matching circuit; and generating plasma inside the vacuum chamber to process the substrate, wherein when a signal from a high frequency oscillator is amplified in an amplifier in a high frequency power source, a signal from a traveling wave output terminal of a directional coupler in the high frequency power source through a low pass filter with a cut-off frequency higher than an oscillating frequency of the high frequency oscillator is compared with a signal from an output power setting circuit in the high frequency power source to apply a constant high frequency power to process the substrate.

21. The plasma processing method according to claim 20, wherein the oscillating frequency (f) and the cut-off frequency (fh) satisfy a relationship of f<fh<2f.

22. The plasma processing method according to claim 20, wherein the substrate is processed while a traveling wave power and a reflected wave power are being monitored on a power indicator based on a signal from the traveling wave output terminal after passing through the low pass filter, and a signal from a reflected wave output terminal of the directional coupler.

23. The plasma processing method according to claim 22, wherein the substrate is processed while a low pass filter with a cut-off frequency higher than the oscillating frequency of the high frequency oscillator is provided between the reflected wave output terminal and the power indicator.

24. The plasma processing method according to claim 20, wherein the oscillating frequency is 0.1 MHz to 3 G MHz.

25. The plasma processing method according to claim 20, wherein the oscillating frequency is 50 MHz to 300 MHz.

26. The plasma processing method according to claim 20, wherein the substrate is processed while a dielectric plate is provided between the antenna and the vacuum chamber, the antenna and the dielectric plate have a structure protruding into the vacuum chamber, the antenna is supplied with the high frequency power through a through hole provided near a center of the dielectric plate, and the antenna and the vacuum chamber are short-circuited with multiple short pins through multiple through holes provided at multiple locations on the dielectric plate different from the center or the periphery, at equal distances from the center of the antenna.

* * * * *